US006559112B2

(12) United States Patent
Fox et al.

(10) Patent No.: US 6,559,112 B2
(45) Date of Patent: May 6, 2003

(54) NEUTRAL CLEANING COMPOSITION WITH MODERATE AND LOW FOAMING SURFACTANTS

(75) Inventors: Derek J. Fox, Racine, WI (US); Ryan E. Kron, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 09/772,733

(22) Filed: Jan. 30, 2001

(65) Prior Publication Data

US 2002/0151449 A1 Oct. 17, 2002

(51) Int. Cl.[7] ..... C11D 17/00

(52) U.S. Cl. ..... 510/278; 510/421; 510/422; 510/505; 510/506; 510/280

(58) Field of Search ..... 510/278, 421, 510/422, 505, 506, 280

(56) References Cited

U.S. PATENT DOCUMENTS

| | | | | |
|---|---|---|---|---|
| 3,707,506 A | | 12/1972 | Lozo | 252/139 |
| 3,840,465 A | | 10/1974 | Knowles et al. | 252/90 |
| 3,994,818 A | | 11/1976 | van der Loo et al. | 252/171 |
| 4,336,165 A | | 6/1982 | Weisensel | 252/528 |
| 4,338,212 A | | 7/1982 | Wegener et al. | 252/174.22 |
| 4,349,448 A | | 9/1982 | Steele | 252/135 |
| 4,366,002 A | | 12/1982 | Carandang | 134/2 |
| 5,300,142 A | | 4/1994 | Cormier | 106/14.14 |
| 5,536,438 A | | 7/1996 | Scialla et al. | 510/372 |
| 5,545,347 A | * | 8/1996 | Ouyang et al. | 510/254 |
| 5,707,956 A | | 1/1998 | Schmid et al. | 510/422 |
| 5,866,528 A | * | 2/1999 | Cala et al. | 510/423 |
| 5,929,014 A | | 7/1999 | Beaujean et al. | 510/336 |
| 5,977,048 A | | 11/1999 | Welch et al. | 510/365 |
| 6,013,611 A | | 1/2000 | Thomas et al. | 510/155 |
| 6,013,613 A | | 1/2000 | Scheper et al. | 510/220 |
| 6,090,762 A | | 7/2000 | Clapperton et al. | 510/108 |

FOREIGN PATENT DOCUMENTS

| | | | |
|---|---|---|---|
| EP | 0 379 256 A2 | 7/1990 | C11D/1/825 |
| EP | 0 794 245 A1 | 9/1997 | C11D/3/37 |
| WO | WO 00/78904 A1 | 12/2000 | C11D/1/66 |

OTHER PUBLICATIONS

One page of a 1999 ad by Shell Chemicals entitled "What is NEODOL?".
Two pages of a 1998 ad by Shell Chemical Products entitled "NEODOL Alcohols and Alcohol Ethoxylates".
Nine pages of online literature dated 1998, from Shell Chemicals entitled "Physical and Chemical Properties".
Twenty–four pages of online literature, dated 1998, from Shell Chemicals entitled "NEODOL".
Two pages of a 1999–2000 ad by BASF Corporation entitled "ICONOL Decyl and Tridecyl Alcohol Ethoxylates".

* cited by examiner

*Primary Examiner*—Necholus Ogden
(74) *Attorney, Agent, or Firm*—Warren R. Bovee; Neil E. Hamilton; Renee J. Rymarz

(57) ABSTRACT

A cleaning composition which includes a moderate foaming surfactant and a low foaming surfactant. A synergistic cleaning effect is produced by the surfactants. In a preferred manner, the cleaning composition is a neutral carpet extraction cleaning composition. However it can also be employed as a cleaner for fabrics and hard surfaces.

13 Claims, No Drawings

NEUTRAL CLEANING COMPOSITION WITH MODERATE AND LOW FOAMING SURFACTANTS

BACKGROUND OF THE INVENTION

1. Technical Field

This invention relates to a carpet cleaning composition. More particularly it relates to a carpet extraction cleaner composition having a neutral pH which combines a moderate and a low foaming surfactant to provide a cleaner composition with better cleaning capabilities than either surfactant alone. Further more the composition has a neutral pH which allows it to be used on all types of carpet including wool carpets without any of the adverse affects that current carpet cleaners exhibit.

2. Background Art

It is known in the art to use a mixture of nonionic surfactants as paste-form detergents. These are described in U.S. Pat. No. 5,929,014. In U.S. Pat. No. 4,336,165 a cationic surfactant is disclosed to interact with a high foaming anionic detergent for use in carpet cleaning. U.S. Pat. No. 5,536,438 describes the use of four different nonionic surfactants for use in carpet cleaning with a good suds profile.

Neodol surfactants are moderate and low foaming available from Shell Chemicals. Tomadol surfactants are moderate and low foaming available from Tomah Products Inc.

The prior art does not provide a carpet cleaning composition which combines a moderate foaming and a low foaming surfactant. Low foaming surfactants are known to be less effective than high and moderate foaming surfactants. Quite unexpectedly it was found that when a moderate and a low foaming surfactant were combined a synergistic cleaning effect resulted. The carpet cleaning composition of the present invention has a neutral pH allowing it to be used on all types of carpets including wool carpets while maintaining a high cleaning ability.

The objects of the invention therefore are:

a. Providing an improved cleaning composition.

b. Providing an improved composition for cleaning carpets.

c. Providing a cleaning composition of the foregoing type which affords a synergistic cleaning effect.

d. Providing a cleaning composition of the foregoing type which is low foaming through typical carpet extraction equipment.

e. Providing a cleaning composition of the foregoing type which can also be employed for cleaning fabrics and hard surfaces.

f. Providing a cleaning composition of the foregoing type which has a neutral pH.

SUMMARY OF THE INVENTION

The foregoing objects are accomplished and the shortcomings of the prior art are overcome by the cleaning composition of this invention which includes a moderate foaming surfactant, a low foaming surfactant and water.

In a preferred embodiment the moderate and low foaming surfactants are alkoxylated surfactants and the cleaning composition is a carpet cleaner.

In another embodiment the ratio of the moderate foaming to low foaming surfactant is 1:1 to 4:1, respectively.

In one aspect, the composition includes a hydrotrope.

In another aspect, the moderate foaming alkoxylated surfactant is a linear primary alcohol ethoxylate with about 6 moles of ethylene oxide, which also includes a low foaming ethoxylated tridecyl alcohol surfactant.

These and still other objects and advantages of the invention will be apparent from the description which follows. In the detailed description below preferred embodiments of the invention will be described in reference to the full scope of the invention. Rather, the invention may be employed in other embodiments.

DETAILED DESCRIPTION

The term "moderate foaming surfactant" as used herein is meant a nonionic or modified anionic surfactant with a Hydrophile Lipophile Balance ("HLB") of approximately 10.5–15, examples of which are a linear primary alcohol ethoxylate with an HLB of approximately 12, an ethoxylated trimethyl nonanol with a HLB of approximately 11, an ethoxylated decyl alcohol with a HLB of approximately 13, a mixed nonionic/anionic surfactant with a linear alcohol alkoxylate/carboxylate and an ethoxylated thioether with a HLB of approximately 11. Commercial products include but are not limited to the following surfactants: Tomadol 91-6, and Tomadol 1-73B, Tergitol TMN-6 (Union Carbide), Iconal DA-6 (BASF), Alcodet SK (Rhodia Inc.) and Burcoterge DG-60 CF (Burlington).

The term "low foaming surfactant" as used herein is meant modified alkoxylated primary alcohols with a HLB of approximately 2–9.5, examples of which are ethoxylated decyl alcohols such as tridecyl alcohols with a HLB of approximately 9 and a linear primary alcohol ethoxylate with an HLB of approximately 9.5. It includes the following surfactants: DeIonic 100-VLF (Deforest Chemicals), Iconal TDA-3 (BASF) and Tomadol 23-4 (Tomah Inc.).

Cleaning test data is presented in the following Examples. The cleaning tests were conducted as follows. The cleaning compositions as described in the following Examples I–XIX were prepared by placing water into a mixing vessel and adding the surfactants in amounts as indicated. Once all surfactants are added the mixture is agitated to uniformity. The testing procedure was conducted as follows:

Equipment and Materials Needed:

1) Carpet:
   Tan, ¼" loop, Polyolefin, 19"×39"

2) Minolta Chroma Meter, CR-310, with DP-301 Data Processor.

3) Soil:
   WFK 09Z, Carpet Soil with Peat Moss, Soot and Cement.

4) Jar Mill, General Utility, Single Tier.

5) Burundum Cylinders:
   3 kg of 1¼"×1¼"
   3 kg of ½"×½"

6) Nylon Beads:
   Vydyne 21 from Solutia

7) Wide Mouth, 3-gallon plastic jar.

8) Roll Mill: Variable speed with ability for clockwise and counterclockwise rotation.

9) Double Face Carpet Tape

10) Small Tank Extractor:
   Castex Anser with 4" hand wand.

The soil was prepared by placing 500 grams of the WFK 09 Z Carpet Soil with Peat Moss, Soot and Cement in ajar mill with 3 kg of 1¼"×1¼" Burundum Cylinders and 3 kg of ½"×½" Burundum cylinders. The jar mill was set on a power setting of 60 and ran overnight (15 hours). The Burundum cylinders and soil were separated using a sieve and a shaker. The soil was transferred to storage jars for future use.

Carpet Soiling Procedure:

All reflectance readings were compared with the original clean strip, before soiling. The Minolta Chroma Meter was calibrated on a standard clean white calibration tile before each set of readings on each carpet.

1) The carpet was laid out in a grid pattern. Five cleaner formulations can be analyzed on one carpet.
2) Fifteen grams of the finely ground soil and 750 g of Nylon Beads were placed in a wide-mouth, 3 gallon plastic jar. The jar and contents were placed on ajar mill. The jar mill was rotated approximately 15 minutes. During this time, the soil completely adheres to the surface of the nylon beads.
3) The cut carpet was placed in the roll mill and secured to the inside circumference of the roll mill with double-faced carpet tape.
4) The soil-coated nylon beads were placed in the roll mill containing the carpet and 2 kg of 1¼"×1¼" Burundum cylinders and 2 kg of ½"×½" Burundum cylinders. The Burundum cylinders were added to aid in the transfer of the soil from the nylon beads to the carpet.
5) The roll mill was operated for 10 minutes in the clockwise direction and 10 minutes in the counter-clockwise direction, for a total of 20 minutes.
6) The carpet was thoroughly vacuumed. The nylon beads were separated from the Burundum cylinders. The Burundum cylinders were reused and the nylon beads were discarded.
7) The carpet was analyzed with a Minolta Chroma Meter, CR-310, with DP-301 Data Processor and the % Soiling was determined.
8) % Soiling Calculation: $(R_I-R_S)/R_I\times100\%$=Soiling Efficiency
   where:
   $R_I$=Initial Carpet Reflectance
   $R_S$=Soiled Carpet Reflectance Extraction Cleaning Procedure:

1) The various carpet-cleaning products were diluted with deionized water to a concentration of 1:320.
2) Each diluted product was alternately placed in a small tank extractor and one strip of carpet was extracted with 3 wet passes and 2 dry passes.
3) The carpets were allowed to dry overnight. The % Cleaning/Soil Removed Reflectance readings were taken and the % Cleaning/Soil Removed was determined for each cleaning product.
4) Cleaning (% Soil Removed) Calculation:

$$(R_C-R_S)/(R_I-R_S)\times100\%=\text{Cleaning Efficiency}$$

Where:
$R_C$=Cleaned Carpet Reflectance
$R_I$=Initial Carpet Reflectance
$R_S$=Soiled Carpet Reflectance 5) The soiling and cleaning processes were repeated three more times for a total of 4 cycles for each surfactant formulation.

The results of the test performed on the claimed invention are explained in Examples I through XIX which follow in Tables 1–4 and 1A-3A. Examples I, II and III all contain the claimed mixture of a low foaming and a moderate foaming composition as indicated on Table 1. These Examples show the improved cleaning ability found with the use of the claimed combination. The improved cleaning results are also contained in Table 1 and Table 1A to show that the combination produces an unexpected improvement in cleaning results. Example II further shows the use of an anti-foaming agent in the formulation. The use of the anti-foaming agent does not affect the cleaning ability as can be seen by comparing the results of the % cleaning difference as set forth in Table 1 and Table 1A.

Examples IV, V and VI use only one surfactant in the formulation while maintaining constant amounts of all the other components of Examples I, II and III. These Examples show the decrease in the cleaning effectiveness as a result of not using the combination of a low foaming surfactant and a moderate foaming surfactant as claimed. Example IV uses only a single moderate foaming surfactant while Examples V and VI use only a single low foaming surfactant. These Examples were tested to show a comparison of the increased cleaning effectiveness of Examples I, II and III to the lower cleaning effectiveness of Examples IV, V and VI.

TABLE 1

| MATERIALS | SUPPLIER | CHEMICAL DESCRIPTION and/or FUNCTION | AMOUNTS IN WT % Ex. I | Ex. II | Ex. III |
|---|---|---|---|---|---|
| TOMADOL 1-73B | Tomah | Linear primary alcohol ethoxylate | 15.00 | 15.00 | 15.00 |
| ICONOL TDA-3 | BASF | Ethoxylated tridecyl alcohol | 16.00 | 6.00 | |
| TOMADOL 23-4 | Tomah | Linear primary alcohol ethoxylate | | | 6.00 |
| SURFYNOL DF-110D | Air Products | Anti-foaming agent | | 2.50 | |
| SXS, 40% | Stepan | Sodium xylene sulfonate | 18.00 | 18.00 | 11.50 |
| PV-93 | Robertet | Fragrance | 0.70 | 0.70 | 0.55 |
| DI WATER | | | 60.30 | 57.80 | 66.95 |
| TOTAL: | | | 100.00 | 100.00 | 100.00 |
| AVERAGE INITIAL % CLEANING: | | | 42.1 | 41.27 | 39.32 |

TABLE 1-continued

| MATERIALS | SUPPLIER | CHEMICAL DESCRIPTION and/or FUNCTION | AMOUNTS IN WT % Ex. I | Ex. II | Ex. III |
|---|---|---|---|---|---|
| AVERAGE FINAL % CLEANING (4 CYCLES): | | | 26.3 | 25.75 | 25.03 |
| % CLEANING DIFFERENCE: | | | 15.8 | 15.52 | 14.29 |
| INITIAL SOILING: | | | 49.4 | 50.00 | 50.76 |
| FINAL % SOILING (4 CYCLES): | | | 48.6 | 48.45 | 50.75 |
| % SOILING DIFFERENCE: | | | -0.8 | -1.55 | -0.01 |

TABLE 1A

| MATERIALS | SUPPLIER | CHEMICAL DESCRIPTION and/or FUNCTION | AMOUNTS IN WT % Ex. IV | Ex. V | Ex. VI |
|---|---|---|---|---|---|
| TOMADOL 1-73B | Tomah | Linear primary alcohol ethoxylate | 21.00 | | |
| ICONOL TDA-3 | BASF | Ethoxylated tridecyl alcohol | | 21.00 | |
| TOMADOL 23-4 | Tomah | Linear primary alcohol ethoxylate | | | 21.00 |
| SXS, 40% | Stepan | Sodium xylene sulfonate | 12.00 | 12.00 | 12.00 |
| ROBERTET PV-93 | | Fragrance | 0.70 | 0.70 | 0.70 |
| DI WATER | | | 66.30 | 66.30 | 66.30 |
| TOTAL: | | | 100.00 | 100.00 | 100.00 |
| AVERAGE INITIAL % CLEANING: | | | 30.14 | 32.63 | 29.74 |
| AVERAGE FINAL % CLEANING (4 CYCLES): | | | 21.01 | 20.37 | 19.04 |
| % CLEANING DIFFERENCE: | | | 9.13 | 12.26 | 10.70 |
| INITIAL SOILING: | | | 50.63 | 50.58 | 50.94 |
| FINAL % SOILING (4 CYCLES): | | | 50.75 | 48.34 | 50.67 |
| % SOILING DIFFERENCE: | | | 0.12 | -2.24 | -0.27 |

Referring to Table 2 and Table 2A Examples VII, VIII and IX use only one surfactant in the formulation while Examples X and XI use a low foaming and a moderate foaming surfactant in combination. Example VII uses only a single moderate foaming surfactant while Examples VIII and IX use only a single low foaming surfactant. Examples VII, VIII and IX show the low cleaning effectiveness as a result of using a single surfactant, either a low foaming surfactant or a moderate foaming surfactant individually. Examples X and XI are used to show the unexpected increase in effectiveness of a combination of a low foaming and a moderate foaming surfactant. The Examples further show the results of the initial and final foam height for each surfactant and the difference when using low foaming and moderate foaming surfactants in combination.

TABLE 2

| MATERIALS | SUPPLIER | CHEMICAL DESCRIPTION and/or FUNCTION | AMOUNTS IN WT % Ex. VII | Ex. VIII | Ex. IX |
|---|---|---|---|---|---|
| TOMADOL 1-73B | Tomah | Linear primary alcohol ethoxylate | 21.00 | | |

TABLE 2-continued

| MATERIALS | SUPPLIER | CHEMICAL DESCRIPTION and/or FUNCTION | AMOUNTS IN WT % Ex. VII | Ex. VIII | Ex. IX |
|---|---|---|---|---|---|
| ICONOL TDA-3 | BASF | Ethoxylated tridecyl alcohol | | | 21.00 |
| DEIONIC 100-VLF | DeForest | Modified alkoxylated primary alcohol | | 21.00 | |
| SXS, 40% | Stepan | Sodium xylene sulfonate | 12.00 | 12.00 | 18.00 |
| DI WATER | | | 67.00 | 67.00 | 61.00 |
| TOTAL: | | | 100.00 | 100.00 | 100.00 |
| AVERAGE % SOILING: | | | 39.81 | 40.37 | 42.12 |
| AVERAGE % CLEANING: | | | 40.78 | 35.71 | 36.61 |
| INITIAL FOAM HEIGHT: | | | 75 | 10 | 12 |
| FINAL FOAM HEIGHT: | | | 70 | 0 | 5 |
| DIFFERENCE: | | | 5 | 10 | 7 |

TABLE 2A

| MATERIALS | SUPPLIER | CHEMICAL DESCRIPTION and/or FUNCTION | AMOUNTS IN WT % Ex. X | Ex. XI |
|---|---|---|---|---|
| TOMADOL 1-73B | Tomah | Linear primary alcohol ethoxylate | 15.00 | 15.00 |
| ICONOL TDA-3 | BASF | Ethoxylated tridecyl alcohol | | 6.00 |
| DEIONIC 100-VLF | DeForest | Modified alkoxylated primary alcohol | 6.00 | |
| SXS, 40% | Stepan | Sodium xylene sulfonate | 12.00 | 18.00 |
| DI WATER | | | 67.00 | 61.00 |
| TOTAL: | | | 100.00 | 100.00 |
| AVERAGE % SOILING: | | | 41.76 | 42.18 |
| AVERAGE % CLEANING: | | | 55.71 | 51.96 |
| INITIAL FOAM HEIGHT: | | | 60 | 55 |
| FINAL FOAM HEIGHT: | | | 40 | 40 |
| DIFFERENCE: | | | 20 | 15 |

As seen in Table 3 and Table 3A Examples XII, XIII and XIV use only one surfactant in the formulation while Examples XV and XVI use a low foaming and a moderate foaming surfactant in combination. Examples XIV and XVI use a different low foaming surfactant than the Examples in Table 1 while Examples XII, XV and XVI use a different moderate foaming surfactant. The Examples again show the low cleaning effectiveness as a result of using a single surfactant, either a low foaming surfactant or a moderate foaming surfactant individually. Example XII uses only a single moderate foaming surfactant while Examples XIII and XIV use only a single low foaming surfactant. Examples XV and XVI are used to show the unexpected increase in effectiveness of a combination of a low foaming and a moderate foaming surfactant. The Examples further show the results of the initial and final foam height for each surfactant and the difference when using low foaming and moderate foaming surfactants in combination.

TABLE 3

| MATERIALS | SUPPLIER | CHEMICAL DESCRIPTION and/or FUNCTION | AMOUNTS IN WT % Ex. XII | Ex. XIII | Ex. XIV |
|---|---|---|---|---|---|
| ICONOL TDA-3 | BASF | Ethoxylated tridecyl alcohol | | 21.00 | |
| TERGITOL TMN-6 | Union Carbide | Ethoxylated trimethyl nonanol | 21.00 | | |

TABLE 3-continued

| MATERIALS | SUPPLIER | CHEMICAL DESCRIPTION and/or FUNCTION | AMOUNTS IN WT % Ex. XII | Ex. XIII | Ex. XIV |
|---|---|---|---|---|---|
| DEIONIC 100-VLF | DeForest | Modified alkoxylated primary alcohol | | | 21.00 |
| SXS, 40% | Stepan | Sodium xylene sulfonate | 12.00 | 18.00 | 12.00 |
| DI WATER | | | 67.00 | 61.00 | 67.00 |
| TOTAL: | | | 100.00 | 100.00 | 100.00 |
| AVERAGE % SOILING: | | | 40.40 | 42.12 | 40.37 |
| AVERAGE % CLEANING: | | | 36.63 | 36.61 | 35.71 |
| INITIAL FOAM HEIGHT: | | | 65 | 12 | 10 |
| FINAL FOAM HEIGHT: | | | 35 | 5 | 0 |
| DIFFERENCE: | | | 30 | 7 | 10 |

TABLE 3A

| MATERIALS | SUPPLIER | CHEMICAL DESCRIPTION and/or FUNCTION | AMOUNTS IN WT % Ex. XV | Ex. XVI |
|---|---|---|---|---|
| ICONOL TDA-3 | BASF | Ethoxylated tridecyl alcohol | 6.00 | |
| TERGITOL TMN-6 | Union Carbide | Ethoxylated trimethyl nonanol | 15.00 | 15.00 |
| DEIONIC 100-VLF | DeForest | Modified alkoxylated primary alcohol | | 6.00 |
| SXS, 40% | Stepan | Sodium xylene sulfonate | 18.00 | 12.00 |
| DI WATER | | | 61.00 | 67.00 |
| TOTAL: | | | 100.00 | 100.00 |
| AVERAGE % SOILING: | | | 40.72 | 40.20 |
| AVERAGE % CLEANING: | | | 51.20 | 48.93 |
| INITIAL FOAM HEIGHT: | | | 20 | 50 |
| FINAL FOAM HEIGHT: | | | 5 | 5 |
| DIFFERENCE: | | | 15 | 45 |

Referring to Table 4, it is seen that Examples XVII and XVIII use only one surfactant in the formulation while Example XIX uses a low foaming and a moderate foaming surfactant in combination. Examples XVII and XIX use a nonionic/anionic moderate foaming surfactant rather than a nonionic surfactant as the previous Examples. Example XIX shows that the use of a nonionic/anionic moderate foaming surfactant does not have as significant an effect on cleaning as the use of a nonionic surfactant and would not be the preferred moderate foaming surfactant for the composition.

TABLE 4

| MATERIALS | SUPPLIER | CHEMICAL DESCRIPTION and/or FUNCTION | AMOUNTS IN WT % Ex. XVII | Ex. XVIII | Ex. XIX |
|---|---|---|---|---|---|
| ICONOL TDA-3 | BASF | Ethoxylated tridecyl alcohol | | 21.00 | 6.00 |
| BURCOTERGE DG-60CF | Burlington | a mixed nonionic/anionic surfactant with a linear alcohol alkoxylate/carboxylate | 42.00 | | 30.00 |
| SXS, 40% | Stepan | Sodium xylene sulfonate | 12.00 | 18.00 | 18.00 |
| DI WATER | | | 46.00 | 61.00 | 46.00 |
| TOTAL: | | | 100.00 | 100.00 | 100.00 |

TABLE 4-continued

| MATERIALS | SUPPLIER | CHEMICAL DESCRIPTION and/or FUNCTION | AMOUNTS IN WT % Ex. XVII | Ex. XVIII | Ex. XIX |
|---|---|---|---|---|---|
| AVERAGE % SOILING: | | | 40.03 | 42.12 | 40.31 |
| AVERAGE % CLEANING: | | | 42.88 | 36.61 | 42.51 |
| INITIAL FOAM HEIGHT: | | | 75 | 12 | 55 |
| FINAL FOAM HEIGHT: | | | 60 | 5 | 40 |
| DIFFERENCE: | | | 15 | 7 | 15 |

It will thus be seen that there is now provided a cleaning composition which affords improved cleaning while maintaining a low foam level. While certain Examples of moderate and low foam surfactants are disclosed, others can be employed provided they meet the definition of HLB balance as set forth herein. Other variations and modifications of this invention will be obvious to those skilled in this art. This invention is not to be limited except as set forth in the following claims.

INDUSTRIAL APPLICABILITY

The compositions of this invention are useful in cleaning carpets as well as fabrics and hard surfaces. They provide a high degree of cleaning efficiency with low foaming properties.

What is claimed is:

1. A carpet cleaning composition consisting of a moderate foaming surfactant a low foaming surfactant;

water, and optionally a fragrance.

2. The composition of claim 1 wherein the ratio of moderate foaming surfactant to low foaming surfactant is about 1:1 to 4:1, respectively.

3. The composition of claim 1 wherein the composition has a neutral pH.

4. The composition of claim 1 wherein the moderate foaming surfactant is nonionic.

5. The composition of claim 1 wherein the moderate and low foaming surfactants are alkoxylated surfactants and the cleaning composition is a carpet cleaner.

6. The composition of claim 5 wherein the moderate foaming ethoxylated surfactant is a linear primary alcohol ethoxylate.

7. The composition of claim 5 wherein the moderate foaming alkoxylated surfactant is ethoxylated trimethyl nonanol.

8. The composition of claim 5 wherein the moderate foaming alkoxylated surfactant is a linear primary alcohol ethoxylate with about 6 moles of ethylene oxide.

9. The composition of claim 5 wherein the low foaming alkoxylated surfactant is an alkoxylated alcohol.

10. The composition of claim 9 wherein the low foaming alkoxylated surfactant is a modified alkoxylated primary alcohol.

11. The composition of claim 9 wherein the low foaming alkoxylated surfactant is an ethoxylated decyl alcohol.

12. The composition of claim 9 wherein the low foaming alkoxylated surfactant is an ethoxylated tridecyl alcohol.

13. A method of cleaning a carpet comprising contacting the carpet with the composition of claim 1.

* * * * *